United States Patent [19]

Phillips et al.

[11] Patent Number: 4,628,701

[45] **Date of Patent: * Dec. 16, 1986**

[54] NON-FLOODING REMOTE AIR COOLED CONDENSERS

[75] Inventors: Parker V. Phillips, Brantford; Ness Lakdawala, St. Lambert; Michel Lecompte, Mont St. Hilaire, all of Canada

[73] Assignee: Hussmann Corporation, Bridgeton, Mo.

[ * ] Notice: The portion of the term of this patent subsequent to Feb. 12, 2002 has been disclaimed.

[21] Appl. No.: 699,925

[22] Filed: Feb. 8, 1985

Related U.S. Application Data

[63] Continuation-in-part of Ser. No. 430,699, Sep. 30, 1982, Pat. No. 4,498,308.

[51] Int. Cl.[4] ..... F25B 39/04

[52] U.S. Cl. ..... 62/184; 62/DIG. 17

[58] Field of Search ..... 62/184, 181, 183, 507, 62/428, 452, 454, 455, 456, DIG. 17; 165/39

[56] References Cited

U.S. PATENT DOCUMENTS

| | | | |
|---|---|---|---|
| 2,911,900 | 11/1959 | Rudy | 98/119 X |
| 3,148,514 | 9/1964 | Mathis | 62/183 |
| 3,390,538 | 7/1968 | Miller | 62/184 X |
| 3,390,539 | 7/1968 | Miner | 62/184 |
| 3,645,107 | 2/1972 | Quick | 62/181 X |
| 4,326,387 | 4/1982 | Friedman | 62/184 |
| 4,498,308 | 2/1985 | Phillips et al. | 62/184 |

FOREIGN PATENT DOCUMENTS

| | | | |
|---|---|---|---|
| 0102849 | 8/1980 | Japan | 62/203 |

*Primary Examiner*—Harry Tanner
*Attorney, Agent, or Firm*—Richard G. Heywood

[57] ABSTRACT

An outdoor air cooled condenser for a refrigeration installation having at least one refrigeration system circuit and including a condenser coil with a heat transfer surface, a condenser housing having air inlet and outlet means for the passage of air across said heat transfer surface, the outlet means including a primary outlet with air flow control means therefor and a plurality of secondary outlets with air displacement means and damper means associated therewith, sensing means for sensing a predetermined condition of refrigerant in the condenser coil, control circuit means for monitoring and integrating the sensed refrigerant condition with respect to a predetermined ideal condition set point value for the refrigeration system circuit and for operating the air flow control means and air displacement means for controlling the amount of air passing through the housing and across the heat transfer surface.

19 Claims, 7 Drawing Figures

INTEGRATOR
CONV.
DECODER
MOTOR CONTROL CKT
THER.
10
11
12
13
17
18
20
23
24
25
25a
25b
26
27
28
29
30
31
32
33
34
35
36
37
38
39
40
41

NON-FLOODING REMOTE AIR COOLED CONDENSERS

This application is a continuation-in-part application based upon U.S. patent application Ser. No. 430,699, filed Sept. 30, 1982, co-pending herewith, now U.S. Pat. No. 4,498,308.

BACKGROUND OF THE INVENTION

The invention relates to an outdoor air cooled condenser assembly for use in large commercial or industrial refrigeration installations, and to methods of controlling condensing temperatures in such condenser assemblies.

In the past, various methods have been proposed for controlling the effective condenser capacity, such as providing variable dampers, fan speed controls, fan cycling and the like. The conventional method predominantly used in commercial and industrial refrigeration is condenser flooding in which the effective area of the condenser is restricted by liquid refrigerant back flooding in the condenser coil in order to regulate or maintain compressor head pressures, particularly under cold ambient conditions. However, condenser flooding requires a large volume of refrigerant which is expensive and the volume needed may exceed the amount required for the normal refrigeration requirements of the evaporators in the refrigeration system, and the other proposed methods have not been totally satisfactory for a number of reasons since they either have used ambient air temperature as a control basis or they have used the refrigerant conditions in a single refrigeration system as a control basis for a multiple system condenser. Sensing ambient air ignores heat rejection load changes as a load factor, and sensing refrigerant conditions of a single refrigeration circuit in a multiple system condenser erroneously presumes that all system circuits have the same condensing needs and should respond to the same conditions as the single circuit being sensed. For example, if the circuit being sensed cycled off because evaporator temperatures were satisfied or the evaporators go into a defrost cycle, then all other system circuits in the multiple condenser would also lose their condensing action and be inoperative because the first system circuit detects no load.

SUMMARY OF THE INVENTION

The invention is embodied in a remote air cooled condenser assembly for a refrigeration installation having at least one refrigeration system circuit, and preferably for use with a plurality of separate refrigeration systems operating at different temperature levels. The condenser assembly houses a condenser coil with heat transfer surfaces for each refrigeration system circuit, and the housing has an air inlet and outlet means for the passage of ambient air across such heat transfer surfaces. The outlet means include a primary outlet with continuously operating air flow control means for controlling ambient flow across a primary section of the condenser coil, and a plurality of secondary outlets with selectively operated air displacement means and damper means associated therewith for controlling ambient air flow across a secondary section of the condenser coil, sensing means for sensing a selected refrigerant condition in the condenser coil, and control circuit means for monitoring and integrating the sensed refrigerant condition relative to a set point value therefor and for operating the primary air flow control means and secondary air displacement means for regulating the volume of air passing through the housing across the heat transfer surfaces of the primary and secondary sections.

The invention is also embodied in a method of controlling condensing temperature in a multi-circuit outdoor air cooled condenser assembly for plural refrigeration systems comprising the steps of sensing a predetermined refrigerant condition in each condenser circuit and providing an error signal representative of the sensed condition in all circuits.

A principal object of the present invention is to provide an outdoor air cooled condenser capable of controlling condensing temperatures using ambient outdoor air at all times, including periods of extremely low entering air temperatures (−40° F.) and severe reductions in heat rejection loads, by control of air volume rather than by control of condenser surface area by flooding.

Another object of the invention is to provide an outdoor air cooled condenser capable of substantially reducing the refrigerant charge of up to several hundred pounds required in large commercial and industrial installations.

Another object of the present invention is to provide an outdoor air cooled condenser that substantially overcomes the disadvantages of the prior art, and which is capable of being used in commercial and industrial installations having a plurality of refrigeration systems operating at different temperature levels.

Another feature of the invention is to provide a remote air cooled condenser that is energy efficient both at the power input to condenser fans and in the power input to compressors of the refrigeration system.

Still another object is to provide an outdoor air cooled condenser which results in reduced maintenance costs by eliminating winter flooding charges thus stabilizing the receiver refrigerant level. Furthermore, the present condenser assembly eliminates backward windmilling of fans which contributes to fan/motor bearing failures.

Another feature of the present invention is to provide a novel method of controlling condensing temperatures in outdoor air cooled multi-circuit condensers for a plurality of separate refrigeration systems operating at different temperature levels.

Another object is to provide a condenser apparatus and method of controlling condensing temperatures which is applicable as a retrofit for existing condensers due to its simplicity and ease of installation.

BRIEF DESCRIPTION OF THE DRAWINGS

Preferred embodiments of the present invention will now be described with reference to the examples illustrated in the accompanying drawings in which.

DESCRIPTION OF THE PREFERRED EMBODIMENTS

Figure 1:
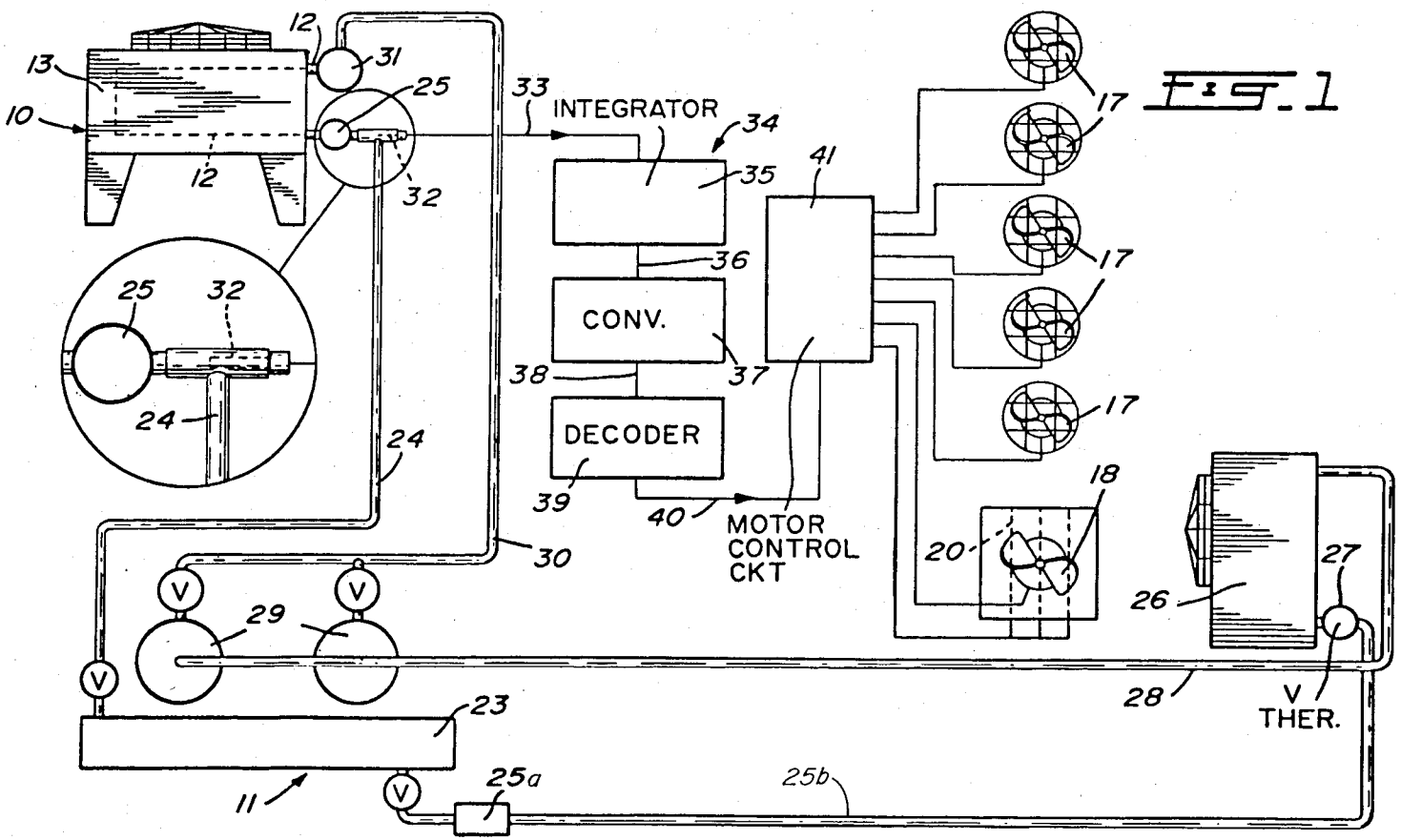
FIG. 1 is a diagrammatic view showing one embodiment of an outdoor air cooled condenser and control circuit of the present invention utilized in a single circuit refrigeration system.

Referring now to the drawings and particularly to FIGS. 1–4 thereof, an outdoor or remote air cooled condenser assembly 10 of the present invention is shown utilized in a refrigeration system 11 having at least one condenser coil 12 disposed in the housing 13 of the condenser 10. The condenser coil 12 is of conventional configuration and includes coil tubing passes 12*a* with spaced fins or heat sink plates 12*b* forming a heat transfer surface area for cooling hot compressed refrigerant gas from compressors 29 to its condensing temperature by flowing ambient air across the coil 12 in a typical manner.

Figure 2:
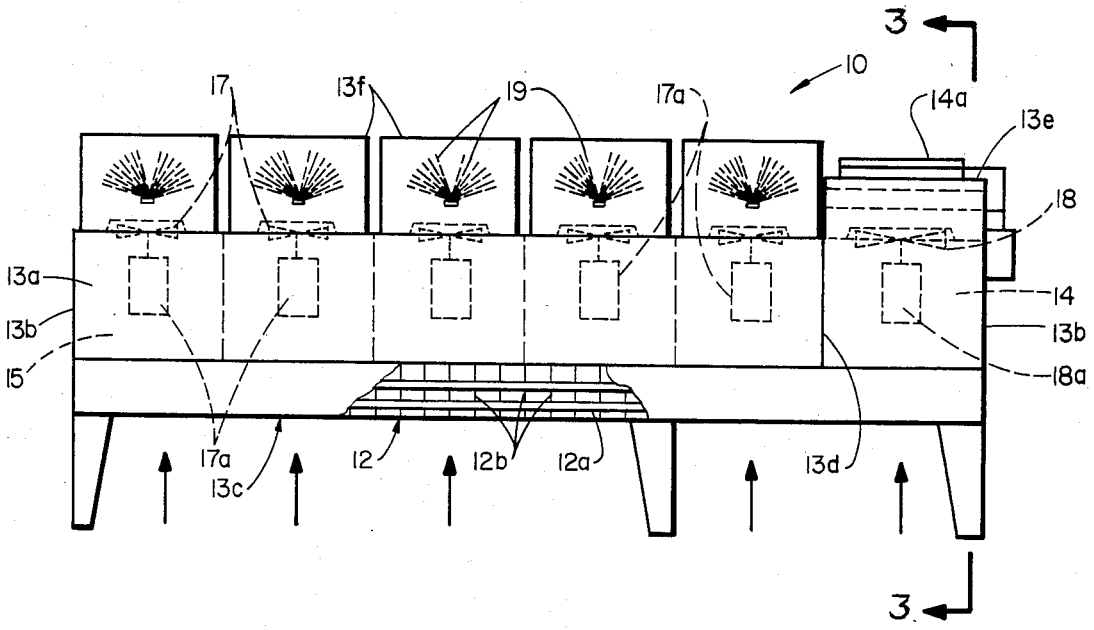
FIG. 2 is a side elevational view of the single circuit condenser shown in FIG. 1.
Figure 3:
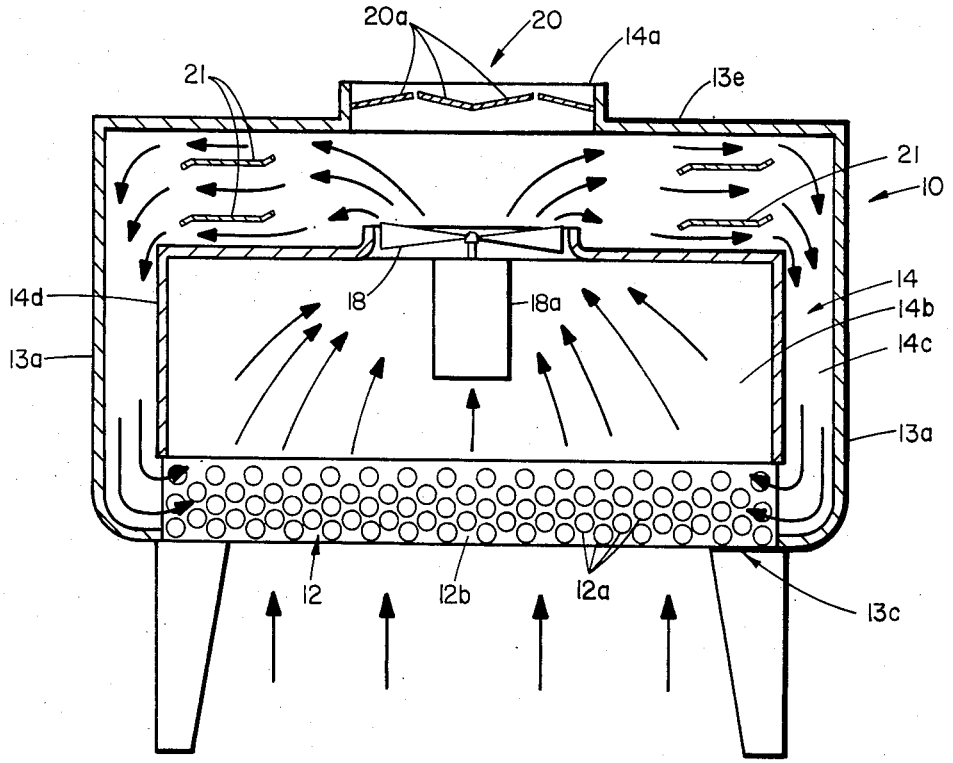
FIG. 3 is an enlarged cross-sectional view of the single circuit condenser as taken substantially along line 3—3 of FIG. 2.
Figure 4:
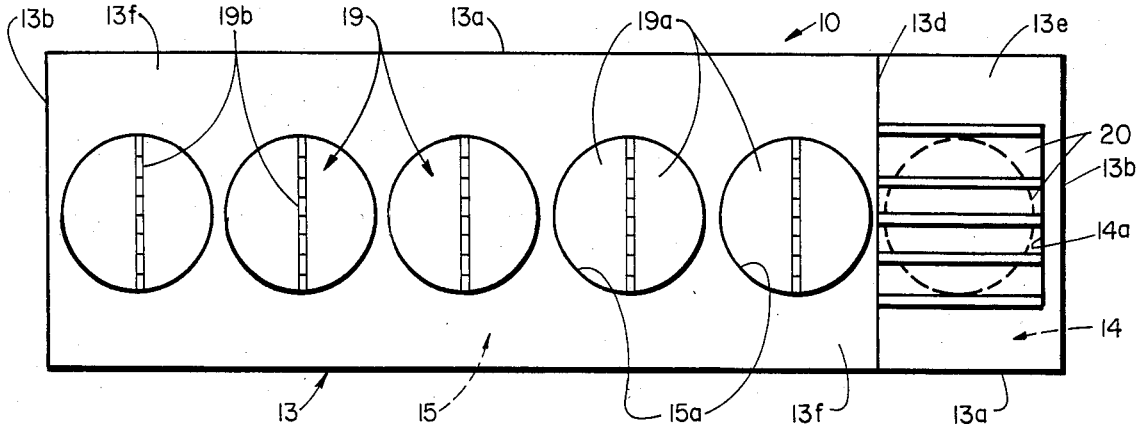
FIG. 4 is a top plan view of the single circuit condenser of FIG. 1.

The housing 13 has opposed side and end walls 13*a* and 13*b*, and an open bottom 13*c* throughout its length that forms an ambient air inlet as shown by the air flow arrows in FIGS. 2 and 3. The housing 13 is also divided by a partition wall 13*d* to form an internal primary air flow chamber 14 having a primary air outlet 14*a* in its top wall section 13*e* and an internal secondary air flow chamber 15 having a plurality of secondary air outlets 15*a* in its top wall section 13*f*. The secondary outlets 15*a* are each provided with a fan 17 driven by motors 17*a* to cause upward air convection flow from the bottom opening 13*c* when these respective fans 17 are operative, and the secondary outlets 15*a* are each provided with free floating, gravity-closed, butterfly dampers 19 having opposed, normally closed, hinged plates 19*a* pivoted on pins 19*b* so that these dampers will be opened by the respective secondary fans 17 during their operation. Thus, when each secondary fan 17 is inoperative, its respective damper 19 will be closed to substantially prevent any ambient air flow across a corresponding secondary section of the condenser coil 12 and, as will be described, the secondary fans 17 are operated sequentially to provide ambient air convection through the condenser 12 as needed to increase or reduce the condensing capacity. It will be understood that the convection dampers 19 of the secondary fans effectively isolate the fan blades 17 from convection currents and ambient winds thus preventing backward "windmilling", which effect contributes substantially to motor bearing failure. Furthermore, the control dampers 19 keep the motors 19*a* contained in the relatively warm environment of the condenser housing 13, when idle, and prevent condensation resulting from ambient temperature and humidity changes.

As shown best in FIG. 3, the primary air chamber 14 is provided with an air flow control means in the form of a fan 18 operated by motor 18*a*. In this embodiment of the invention the primary chamber 14 is divided into an inner chamber 14*b* and an outer air flow passage or chamber 14*c* by a partition wall 14*d*, and the fan 18 is disposed in the upper partition wall in alignment with the primary outlet 14*a* so as to define a primary flow path for ambient air through the bottom opening 13*c* of the housing 13 and across the condenser coil primary section disposed at the lower end of the inner chamber 14*b* adjacent to the bottom opening 13*c*. The air flow control means for the primary outlet 14*a* also includes a controllable damper 20 formed of a plurality of ganged baffle plates 20*a* which are modulated to vary the size of the outlet 14*a* from a fully open position to a fully closed position. Other air recycle dampers 21 are provided in the lateral flow paths defined by the outer flow passages 14*c* around the interior of the housing side walls 13*a* to the condenser coil 12, as will appear.

Referring again to FIG. 1, the refrigeration circuit or system 11 includes a receiver 23 which receives refrigerant condensate at its saturation temperature through conduit 24 from the outlet 25 of the condenser coil 12, and the outlet of the receiver 23 is connected through a conventional dryer 25A by liquid line 25B to a thermostatic expansion valve 27 forming the inlet to an evaporator coil 26. It will be understood that a typical refrigeration circuit 11 in a supermarket or like commercial installation may include a multiplicity of refrigerated fixtures cooled by evaporators 26, although only one such coil 26 is shown for disclosure purposes. A suction line 28 connects the outlet of the evaporator 26 to the suction side of compressors 29 for operating the system 11, and the compressors compress the gaseous refrigerant and add heat of compression to the latent heat load of the evaporators and discharge this superheated gaseous refrigerant through discharge line 30 to the inlet 31 of the condenser coil 12 in which the refrigerant is again reduced to its saturation temperature to complete the cycle.

The outlet 25 of the condenser coil 12 is provided with a sensor 32 for sensing a predetermined condition of the refrigerant at the outlet and, although a temperature sensing probe is presently preferred, the known fixed relationship of temperature and pressure of any refrigerant will permit either a temperature or pressure sensor to be used. The sensor detects the temperature (pressure) and produces a continuous input data value representative thereof, which data is fed through a wire circuit connection 33 to the input of a control circuit 34 having an integrator circuit 35 having its output 36 connected to a converter unit 37. The output of the converter unit 37 is connected to a decoder 39, which has its output 40 connected to a motor control circuit 41. The integrator circuit 35 is programmed with a set point value representing an ideal condition for the condenser output temperature at design conditions for the refrigeration system 11, and the integrator circuit analyzes and integrates the input data received from the sensor 32 against the set point value to produce an error signal correlating these values or value deviations. The error signal is converted by the converter unit 37 to a usable form for the decoder circuit 39, which produces a control signal through its output 40 to the motor control circuit 41 which controls the operation of the dampers 20 of the primary air flow control means and the operation of the secondary fan means 17, 17*a* to control the amount of ambient air passing through the condenser coil 12 dependent upon the sensed condition value of the refrigerant and the need for more or less condenser capacity toward maintenance of the ideal condition set point value.

In general, the input data to the control circuit 34 is representative of the heat rejection load on the condenser 12 and the ambient air temperature entering the housing 13. Whenever the refrigerant temperature deviates from the ideal condition set point value beyond a preselected positive or negative tolerance level, the secondary fans 17 are activated or de-activated and the primary damper 20 is modulated automatically by the motor control circuit 41 so that the temperature of the refrigerant at the condenser output 25 will be brought toward the design operating set point value for optimum condensing pressure of the refrigerant.

In the operation of the condenser assembly 10 when substantially full condensing capacity is required as during warm weather with higher ambient temperatures, the primary air moving means 18 and all secondary fans 17 will be operating to provide maximum ambient air flow across the primary and secondary coil sections in the primary and secondary chambers 14 and 15. In other words, at design entering air temperatures and at design heat rejection loads the input data of the refrigerant condition from the sensor 32 is sent to the integrator circuit 35 which analyzes and correlates this data against the established set point value and, if within the positive and negative tolerance range of the set point value, the error signal to the motor control center 41 will keep all air moving means 18, 17 operative. Any changes in heat rejection load or entering air temperature are immediately identified by the sensor 32 which transmits continous input data to the integrator circuit 35. The tolerance range is preselected, such as 1.5° F. above and below the set point value, and deviations of the sensed input data from the set point value that are within the tolerance range are accommodated by the primary dampers 20 as controlled by positive or negative error signals sent to the motor control circuit 41 to open or close this damper to attempt to maintain the sensed refrigerant condition (i.e. temperature) at the set point value. Thus, if the data is above the preset value, all fans will operate and the damper 20 will be opened for maximum air flow across the condenser coil 12 and, as the sensed temperature decreases, the damper 20 will be modulated closed. In the event the sensed refrigerant temperature falls below the lower or negative tolerance limit, such as by dropping 2° F. below the set point value, then one of the secondary fans 17 will be shut off automatically by the motor control circuit 41. This decrease in ambient air volume through the secondary chamber 15 naturally will tend to produce a rise in the sensed refrigerant temperature and the damper 20 will be modulated open to adjust the air volume toward a compensating factor that will maintain the sensed refrigerant condition at the set point value. However, if the sensed refrigerant temperature remains below the lower tolerance limit, even with the damper 20 closed, then another secondary fan 17 will be shut off and the dampers 20 again modulate to control the cooling ambient flow toward maintenance of the set point value. This process continues during decreasing ambient temperatures until only the primary fan 18 remains on and the dampers 20 are fully closed, as during extreme winter conditions. At such time, the air flow through the inner primary chamber **14*b* may be directed laterally through the outer air recycle chamber 14*c* back to the inlet side of the primary coil section to minimize intake of fresh cold ambient air, and the dampers 21 may be modulated to further reduce air volume through the primary fan 18 by creating a more static inner primary chamber 14*b*. Should the refrigerant temperature at any time rise above the upper tolerance limit of the set point value when the primary damper 20 has fully opened, then one of the secondary fans 17** will be switched on to increase volumetric ambient air flow and condenser capacity to reduce the sensed refrigerant temperature back toward the set point value.

A brief mathematical explanation follows. With decreasing ambient air temperatures (and lowered humidity which effects the heat of rejection load), the volume of ambient air flow across the condenser coil 12 is reduced to maintain a set point condensing temperature value of 90° F. This adjustment of air volume initially occurs in the secondary section by sequentially stopping the secondary air moving means until all fans 17 are idle and their convection dampers 19 are closed. When the error signal to the motor control circuit 41 stops one of the secondary fans 17, the volume of air flow through the heat transfer surface of the coil 12 is $$(N-1)\times(CFM/N)+[0.05\ (CFM/N)]$$

where

CFM=total design air volume, and

N=number of fan sections.

If the error signal continues to remain below the set point value, or if it rises and then again falls below the preset value, the integrated signal to the motor control circuit 41 will cause one of the remaining fans 17 to become idle and its convection control damper 19 to close. Thus, a change takes place from: $(N-1)\times(CFM/N)+[0.05\ (CFM/N)]$ to $(N-2)\times(CMF/N)+[2\times0.05\ (CFM/N)]$.

Without a comparable immediate change in load or entering air temperature, an immediate rise in condensing temperature is sensed. The sensors immediately transmit this change to the integrator 35 and the integrated signal to the motor control circuit 41 causes the control dampers 20 of the primary air control section to modulate open. This control sequence is repeated until all secondary air fans 17 are idle and their convection control dampers 19 are closed. The air volume now flowing through the coil heat transfer surface is:

$$[N-(N-1)\times(CFM/N)]+[(N-1)\times0.05\ (CFM/N)].$$

Assuming that the total heat of rejection load is unchanged from design conditions and that only a reduction in entering ambient air temperature has occurred, the effective temperature difference at which the condenser is operating can be expressed as:

$$TD_2=\frac{CFM}{[N-(N-1)\times(CFM/N)]+[(N-1)\times.05(CMF/N)]}\times TD_1$$

where $TD_1$=design temperature difference, $TD_2$=effective temperature difference, N=number of fan sections, and CFM=design air volume.

If N=6 (as in FIG. 2),

CFM=48,000, $TD_1$=15, then $TD_2$=72° F. Assuming that the preset control value is equivalent to 90° F. condensing temperature, then the ambient air entering the heat transfer surface is 90°−72°=+18° F. Thus, the primary control damper 20 must now offset the remaining 58° F. temperature decrease, and a 50% reduction in the heat of rejection load.

The sensor 32 continues to transmit input data to the integrator 35 to control the air volume through the primary section from 100% of primary fan capacity down to, theoretically, zero %, but some minimal leakage will occur with even the best of damper means.

It will be understood that the condenser coil 12 for the refrigeration system 11 is sized to design capacity to handle the heat of rejection load, which consists primarily of the latent heat load imposed by fixture products and the room ambient imposed on the evaporator coil 26 together with the compressor load, and which establishes the refrigeration needs to be satisfied by compressor/condensing operations. The condenser 12 is sized upon the Delta-T (ΔT), which is the difference between ambient air temperature (cooling air) and the saturated condensing temperature to be achieved, and the condensing temperature at the condenser outlet (25) will determine what the compressor head pressure is. Thus, if the design ΔT is 15° and the entering air temperature is 90° F., the saturation temperature will be 105° at the condenser outlet 25. The design objective of the present invention is to maintain the condensing temperature at a minimum of 90° F. even in the presence of a 50% reduction in heat rejection with entering ambient air temperatures of −40° F. resulting in a ΔT of 7½° F. Regulation of the volume of air across the condenser is directly proportional to regulation of condenser heat transfer area, so air volume control can be substituted for conventional condenser flooding for maintaining condensing temperatures and for effective compressor head pressure control.

Figure 5:
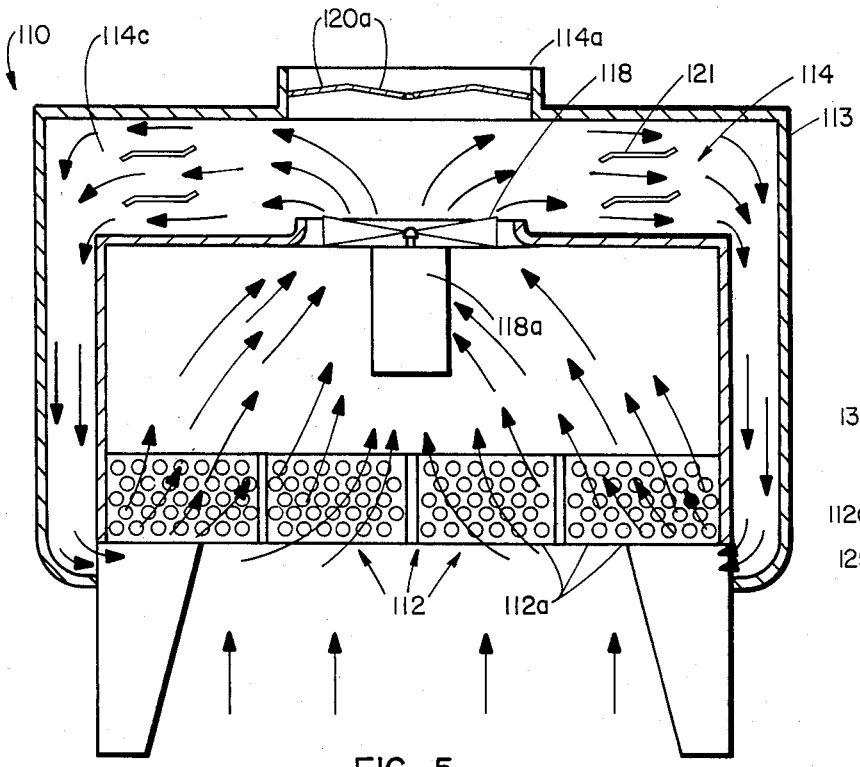
FIG. 5 is a cross-sectional view similar to FIG. 3, but showing a multi-circuit condenser for plural refrigeration systems.
Figure 6:
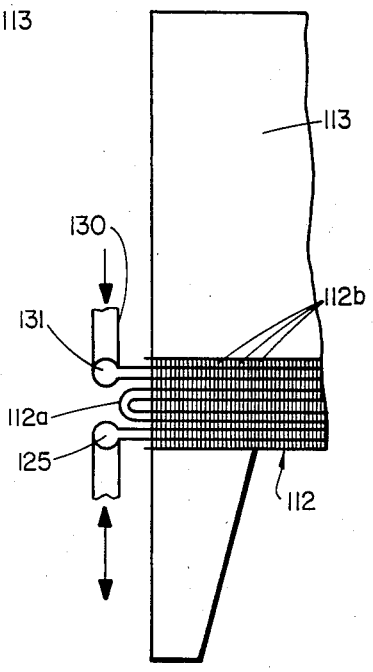
FIG. 6 is a fragmentary side view showing the piping connection to a condenser circuit.

FIGS. 5 and 6 show a multiple coil outdoor condenser assembly 110 having a separate coil circuit 112 for each of a plurality of separate refrigeration systems (111) as typically found in a supermarket or like commercial store for operating the different refrigerated food display and storage fixtures therein over a wide range of refrigeration temperatures. The condenser assembly 110 includes a housing 113 and primary and secondary ambient air flow control means similar to that shown in FIGS. 1–4. In the multiple coil condenser assembly 110, the outlet 125 of each coil circuit 112 is provided with a temperature sensor 132, which sense and deliver saturation temperature input data from each of the respective refrigeration systems to the integrator circuit 35 of the control circuit 34. This data from the different condenser coil circuits 112 is integrated and averaged to establish a composite or integrated value relative to the ambient entering air temperature and heat of rejection load of the respective systems for comparative analysis with the condition set point value from which an integrated error signal is produced for decoding and signalling the motor control circuit 41 to operate the primary air flow control means 18, 20 and secondary air displacement means **17, 17*a*** to obtain optimum condenser operation.

The operation of a multi-circuit condenser assembly 110 is substantially the same as that described for a single system condenser assembly 10 except that the need for compensating air volume modulation includes the averaging of heat of rejection loads of the various refrigeration systems in addition to changes in the ambient entering air temperature. Assuming that no change occurs in ambient air temperature, the input data from the respective coil circuits 112 may produce integrated signal deviations from the design set point value based upon changes in heat rejection loads in these systems calling for additional or reduced condensing capacity, and the motor control circuit 41 operates the primary and secondary air control means 18, 20 and 17 in response to such integrated signal deviations from the set point value as previously described.

Figure 7:
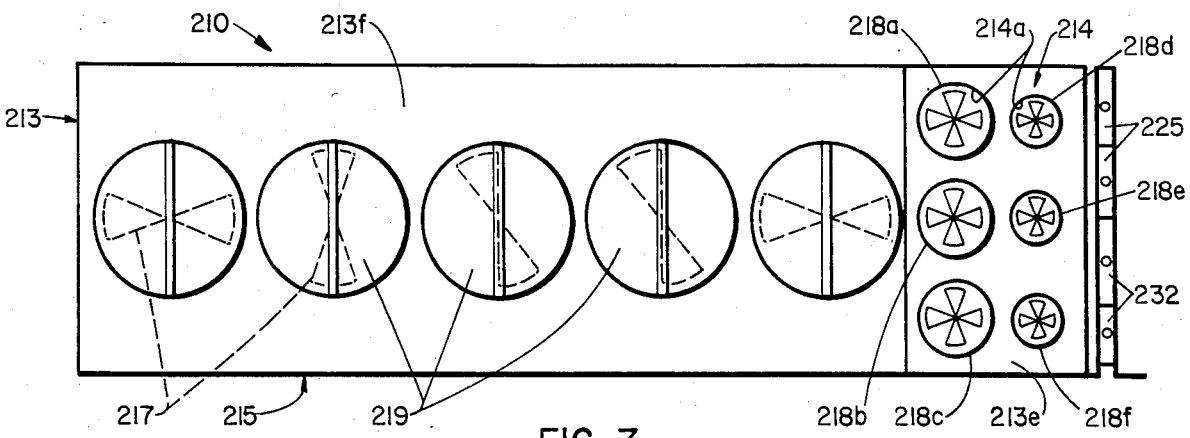
FIG. 7 is a top plan view showing another embodiment of an outdoor air cooled condenser embodying the invention.

Referring now to FIG. 7 wherein another embodiment of the condenser assembly 210 is shown, this assembly deviates from the condenser assembly embodiments 10 and 110 of FIGS. 1–4 and 5–6 primarily in the form of the primary air flow control means. Whereas in the other embodiments, a single primary air mover 18 and controllable modulating damper 20 is utilized to variably modulate the volume of air flow through the primary section of condenser coil 12, 112, the FIG. 7 embodiment utilizes a plurality of primary air moving fans **218*a*, 218*b*, 218*c*, 218*d*, 218*e* and 218*f*. This six fan arrangement is given by way of example in showing incremental volumetric proportioning of air flow through the primary sections of multicircuit condenser coils 212 having outlets 225. The large fans 218*a*, 218*b* and 218*c* may have a CFM capacity of 2000 CFM, the fans 218*d* and 218*e* have a capacity of 1000 CFM and the fan 218*f* has a capacity of 500 CFM, thus providing variable air flow through the primary chamber 214 from a minimum volume of 500 CFM and a maximum of 8500 CFM with 15 intermediate 500 CFM increments of control. Although not shown, it will be understood that gravity-operated, free swinging dampers similar to the secondary dampers 19, 119 will be provided for each of the fan outlets 214*a* so that these outlets will be closed to protect the respective inoperative primary fans. However, in this embodiment there is no by-pass outer chamber (14*c***).

It will be understood that different primary fan combinations may be provided and that the six fan system **218*a*–218*f* is given only by way of example. For instance, a four fan combination having one fan at a 500 CFM capacity, one fan at a 1000 CFM capacity, one at 2000 CFM and one at 4000 CFM will produce 15 increments of air flow totaling 7500 CFM with 500 CFM increments. Inasmuch as at least one continuously operating fan (218) is important in the primary coil section chamber 214**, particularly in multi-circuit condenser assemblies, it is also within the purview of the invention to provide a variable speed fan control on the final or minimum stage of air flow control so that the 500 CFM fan can be reduced further without short circuiting air flow or otherwise throttling the fan operation with backpressure.

In the operation of the FIG. 7 embodiment the plural binary fans **218*a*–218*f* provide a precise ambient air flow control through the primary chamber 14 with at least one fan being operative at all times. The fans 218*a*–218*f* are controlled by the motor control circuit 41 to operate in various combinations of variable air volume in lieu of using modulating dampers (20), and the operation of this embodiment is controlled by the integrator circuit 35** in all respects in the same manner as previously described.

The invention covers all modifications of the various embodiments herein described that are within the scope of the appended claims.

What is claimed is:

1. An outdoor air codled condenser assembly for a continuously operating refrigeration system having at least one refrigeration circuit and plural evaporator means adjusted to different varying load conditions, said condenser assembly including a condenser coil having a heat transfer surface for said refrigeration circuit, a condenser housing including a primary air flow chamber containing a primary section of said condenser coil and a separate secondary air flow chamber containing a section of said condenser coil, said condenser houwing having an open air inlet for the passage of ambient air across the primary and secondary section of said coil heat transfer surface and said primary and secondary chambers having primary and secondary outlets respectively, air flow control means associated with said primary chamber for effecting continuous air circulation through the primary section of said condenser coil, said air flow control means including selectively operable means for incrementally varying the volumetric air flow through said primary chamber and said primary section therein, air displacement means associated with said secondary chamber for effecting air flow therethrough, sensing means connected to the refrigerant outlet from said condenser coil to sense a predetermined condition of refrigerant in said condenser coil, control circuit means for monitoring said sensed refrigerant condition with respect to an established ideal condition set point value for said refrigeration system and for controlling said air flow control means of said primary outlet and said air displacement means of said secondary outlet to regulate the volume of air passing through the respective primary and secondary chambers of said condenser housing and said condenser coil heat transfer surfaces therein in response to changes in said refrigerant condition resulting from the heat rejection load in said condenser coil or the entering ambient air temperature in said condenser housing, whereby to substantially maintain said refrigeration system in constant operation at a preselected ideal condition set point value relative to the sensed refrigerant condition.

2. The condenser assembly according to claim 1, in which said control circuit means includes an integrator circuit programmed with said ideal condition set point and providing preselected positive and negative tolerance limits deviating from said set point.

3. The condenser assembly according to claim 2, in which said sensing means produces input data of the sensed refrigerant condition representative of said heat rejection load of said condenser coil or the entering ambient air temperature in said condenser housing, and said integrator circuit analyzes said input data in comparison with the ideal condition set point and produces an error signal dependent upon the relative deviation in values between such input data and said ideal condition set point.

4. The condenser assembly according to claim 3, in which said control circuit means includes converter and decoder means for converting and translating said error signal into usable form, and motor control means for operating said air flow control means and air displacement means in response to preselected deviations in said converted error signal from said converter and decoder means.

5. The condenser assembly according to claim 4, in which said air flow control means comprises at least one primary air moving means constructed and arranged in said condenser housing to move ambient air across said primary section of said condenser coil heat transfer surface to said primary outlet, and said selectively operable means comprising damper means for variably controlling the air flow area of said primary outlet between fully open and closed positions to compensate for data signal variations within said positive and negative tolerance limits.

6. The condenser assembly according to claim 5, in which said damping means comprise angularly variable baffles secured in said primary outlet opening to regulate the volume of air displacement therethrough, and the operation of said baffles being selectively controlled by said motor control means.

7. The condenser assembly according to claim 6, including damper controlled by-pass air passages in said condenser housing for producing modulating air flow recirculation from said primary air moving means to the inlet side of said condenser coil only when said controllable damping means is in fully closed position.

8. The condenser assembly according to claim 4, in which said selectively operable means comprises a plurality of air moving means constructed and arranged in said condenser housing for selective operation in variably moving ambient air through said primary section of said condenser coil in response to deviations of converted error signals within the positive and negative tolerance limits of said ideal condition set point.

9. The condenser assembly according to claim 8, in which said additional air moving means are of different volumetric air moving capacity, and said motor control means includes means for selectively operating said additional air moving means in varying combinations to produce incremental volumetric adjustment of primary air flow through said primary section.

10. The condenser assembly according to claim 5, in which said air displacement means is constructed and arranged in said condenser housing to move ambient air across said secondary section of the condenser coil heat transfer surface to said secondary outlet, and including damper means movable between a fully closed inactive position and a fully open active position when said air displacement means is operative.

11. The condenser assembly according to claim 10, in which said air displacement means is operated by said motor control circuit for increasing the volumetric ambient air displacement through said condenser housing to compensate for data signal variations exceeding the positive tolerance limit of said ideal condition set point.

12. The condenser assembly according to claim 10, in which a plurality of air displacement and damper means are provided for said secondary chamber and each is associated with a secondary outlet, and said motor control means selectively activates said plural air displacement means when said data signal variations are above said positive tolerance limit and deactivates selected air displacement means when said data signal variations are below said negative tolerance limit.

13. The condenser assembly according to claim 1, wherein there are a multiplicity of separate refrigeration systems for operating plural evaporator means at different levels, and each of said systems having a condenser coil with a heat transfer surface disposed in said condenser housing.

14. The condenser assembly according to claim 13, in which said sensing means comprises a separate sensor connected to the refrigerant outlet of each of said condenser coils to sense a predetermined condition of the refrigerant in its associated condenser coil.

15. The condenser assembly according to claim 14, in which said control circuit means includes an integrator circuit programmed with said ideal condition set point and providing preselected positive and negative tolerance limits deviating from said set point, and in which said separate sensors each produces input data of the sensed refrigerant condition in the respective condenser coils, and said integrator circuit integrates and analyzes such input data in comparison with the ideal condition set point and produces an error signal dependent on the relative average deviation in values between the input data base and said ideal condition set point.

16. A method of controlling condensing temperatures in an outdoor air cooled condenser having at least one refrigeration circuit connected to a condenser coil assembly having a heat transfer surface and being secured in a condenser housing having air inlet and outlet means with primary air control means and secondary air displacement means for the convection of ambient air from said inlet to said outlet means about said heat transfer surface, said method comprising the steps of:

(i) sensing a refrigerant condition in said condenser coil and establishing an input data base representative of said condition, (ii) analyzing said input data base with respect to a predetermined set point value forming an ideal refrigerant condition for said refrigeration system and producing a control signal, (iii) controlling said air displacement means when said control signal exceeds positive or negative tolerance limits from said set point value, and (iv) controlling said primary air control means when said control signal is within said tolerance limits but deviates from said set point value whereby to substantially maintain said refrigeration system operating at said set point value.

17. The method according to claim 16 wherein said step (ii) of analyzing said input data base comprises:

(a) providing an output signal representative of the control signal derived from said data base deviation relative to said set point value, (b) converting said output signal to feed a decoder circuit, and (c) decoding said converted signal to provide control signals to a motor control circuit for controlling said secondary air displacement means and primary air control means.

18. The method according to claim 16, in which said air cooled condenser has a plurality of refrigeration circuits for multiple refrigeration systems and wherein steps (i) and (ii) comprise:

(a) sensing a refrigerant condition in each of said refrigeration circuits, and (b) analyzing and integrating the respective input data bases thereof and producing an integrated control signal relative to the set point value of the ideal refrigerant condition.

19. The method according to claim 16, in which said primary air control means comprise a plurality of different volumetric capacity air moving means in a primary housing section of said condenser coil, and wherein step (iv) comprises:

(a) selectively controlling the operation of said plural air moving means in different combinations to variably control ambient air displacement through said primary housing section.

* * * * *

UNITED STATES PATENT OFFICE

CERTIFICATE OF CORRECTION

Patent No. 4,628,701 Dated December 16, 1986

Inventor(s) Parker V. Phillips, Ness Lakdawala and Michel Lecompte

It is certified that error appears in the above-identified patent and that said Letters Patent are hereby corrected as shown below:

Claim 1 -

Column 8, line 61, "codled" should be --cooled--; line 64, "adjusted" should be --subjected--.

Column 9, line 2, before "section" insert --secondary--; line 3, "houwing" should be --housing--; line 4, "section" should be --sections--.

Claim 10 -

Column 10, line 55, before "levels" insert --temperature--.

Signed and Sealed this

Third Day of March, 1987

*Attest:*

*Attesting Officer*

DONALD J. QUIGG

*Commissioner of Patents and Trademarks*